US008887323B2

(12) United States Patent
Oberholzer et al.

(10) Patent No.: US 8,887,323 B2
(45) Date of Patent: Nov. 18, 2014

(54) APPARATUS FOR ELECTRICALLY TRIGGERING WATER DISCHARGE

(75) Inventors: Roland Oberholzer, Uster (CH); Florian Meier, Reichenburg (CH); Raffael Zingg, Wolfhausen (CH)

(73) Assignee: Geberit International AG, Jona (CH)

( * ) Notice: Subject to any disclaimer, the term of this patent is extended or adjusted under 35 U.S.C. 154(b) by 414 days.

(21) Appl. No.: 13/415,172

(22) Filed: Mar. 8, 2012

(65) Prior Publication Data

US 2012/0228532 A1 Sep. 13, 2012

(30) Foreign Application Priority Data

Mar. 9, 2011 (EP) ..... 11157487

(51) Int. Cl.

| | |
|---|---|
| ***F16K 31/02*** | (2006.01) |
| ***E03D 1/012*** | (2006.01) |
| ***E03D 5/02*** | (2006.01) |
| ***E03D 5/10*** | (2006.01) |

(52) U.S. Cl.

CPC ..... *E03D 1/012* (2013.01); *E03D 5/028* (2013.01); *E03D 5/105* (2013.01)

USPC ..... 4/623; 251/129.04

(58) Field of Classification Search

USPC ..... 251/129.01, 129.04; 4/623, 313

See application file for complete search history.

(56) References Cited

U.S. PATENT DOCUMENTS

| | | | | |
|---|---|---|---|---|
| 3,551,919 | A * | 1/1971 | Forbes | 4/313 |
| 5,033,508 | A * | 7/1991 | Laverty, Jr. | 251/129.04 |
| 5,369,818 | A * | 12/1994 | Barnum et al. | 4/623 |
| 5,694,653 | A * | 12/1997 | Harald | 4/623 |
| 5,868,311 | A * | 2/1999 | Cretu-Petra | 251/129.04 |
| 5,950,983 | A * | 9/1999 | Jahrling | 251/129.04 |
| 6,250,601 | B1 * | 6/2001 | Kolar et al. | 251/129.04 |
| 7,107,631 | B2 * | 9/2006 | Lang et al. | 4/623 |
| 7,228,874 | B2 * | 6/2007 | Bolderheij et al. | 137/801 |
| 7,278,624 | B2 * | 10/2007 | Iott et al. | 251/129.04 |
| 2007/0295711 | A1 | 12/2007 | Striegler et al. | |
| 2008/0005833 | A1 * | 1/2008 | Bayley et al. | 4/623 |
| 2008/0109956 | A1 * | 5/2008 | Bayley et al. | 4/623 |
| 2008/0263889 | A1 * | 10/2008 | Fukaya et al. | 34/267 |

FOREIGN PATENT DOCUMENTS

| | | |
|---|---|---|
| AT | 009 069 U1 | 4/2007 |
| EP | 1 867 613 A1 | 12/2007 |
| EP | 1 961 876 A2 | 8/2008 |

* cited by examiner

*Primary Examiner* — John Bastianelli

(74) *Attorney, Agent, or Firm* — Sughrue Mion, PLLC

(57) ABSTRACT

An apparatus for electrically triggering water discharge is connected to an operating plate (1) and a sensor (31) that is arranged in a rearwards region. The operating plate (1) is transparent or translucent for human visible and infrared light wavelengths and provides at least one indication surface region (42, 43). The indication surface region has a partially transmissive coating (22, 23), behind which are one or more light sources (10, 11) emitting light that is visible to the human eye. At least one signal-transmitter surface region (21) is provided with a coating that is non-transmissive for light that is visible to the human eye and is transparent or translucent for infrared wavelengths, behind which light sources (20), which emit one or more infrared wavelengths, are arranged. At least one sensor surface region (51; 52, 53) is disposed remote from the user and has a coating that is non-transmissive for light that is visible to the human eye and is transparent or translucent for infrared wavelengths, behind which are one or more sensors (31; 32, 33) that are sensitive to infrared wavelengths.

17 Claims, 1 Drawing Sheet

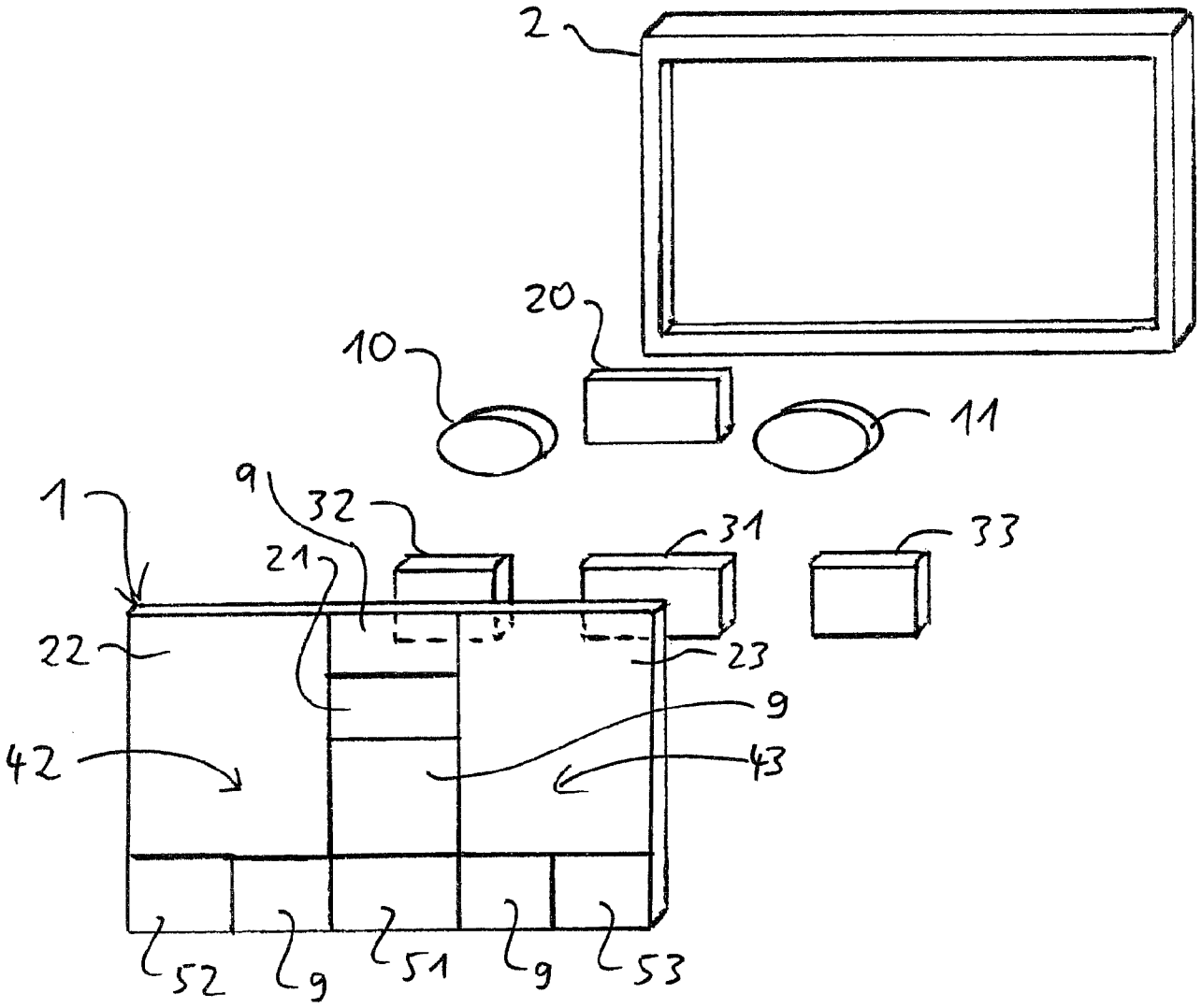
2
20
10
11
33
31
23
9
43
53
9
51
9
52
32
21
9
1
22
42

APPARATUS FOR ELECTRICALLY TRIGGERING WATER DISCHARGE

TECHNICAL FIELD

The present invention relates to an apparatus for electrically triggering water discharge, having an operating plate and a sensor, wherein the sensor is arranged in the rearwards region, when viewed by a user triggering the water discharge, behind the operating plate.

PRIOR ART

A large number of operating elements for electrically triggering water discharge, in particular flushing devices, are known from the prior art.

EP 1 961 876 describes an apparatus for electrically triggering the flushing of a toilet, in which the operating plate is a glass plate or a plate made of a non-conductive material. Provided are two sensor buttons, which are arranged behind the operating plate. The sensor buttons are capacitively operating sensors, which contactlessly detect one or more approaching fingers or the approaching hand of a user from the opposite side of the operating plate. The operating plate is therefore a plate made of an electrically non-conductive material, in particular a glass plate. The sensor technology of the capacitive sensor buttons is adhesively bonded on the rear side of the operating plate. Operating symbols are arranged, for example by way of print, on the front side of the operating plate in front of the region of the sensor buttons.

In this manner, hygienic operation can be ensured; not only is the flushing operation triggered contactlessly, the operating plate can also be installed seamlessly into the front of a toilet flushing system, with the result that cleaning can become a simple task.

Such actuation elements are likewise known from the kitchen area. EP 1 867 613, for example, discloses a glass ceramic plate, which is intended to have a viewing window. This viewing window is brought about by applying an opaque coating on the rear side of a ceramic plate, which is actually see-through, and by only leaving the desired viewing window free. Likewise provided in this region is a capacitive sensor, with which the function of the heating plate is triggerable. Additionally provided behind the glass ceramic plate in the viewing-window region is a luminous means so as to be able to provide feedback to the user. In addition to the opaque coating, a noble-metal coating is applied, which supports the technical function of the optimization of the actuation of the capacitive sensor and also has a partially reflective design. Transmittance is in the range of 1 to 20%, with the result that the luminous means can be seen.

AT 009 069 U1 discloses a flushing installation with a viewing window, behind which viewing window a proximity sensor is provided, which operates on a light-reflection basis and with which the installation is triggerable. The infrared sensor, also referred to as IR sensor for short, is intended to be able to detect a user approaching the flushing installation, while being able to distinguish when the installation is intended to be triggered by the user "pushing" appropriate button regions. Triggering is ensured via an infrared distance measurement. In this case, an optical luminous means is provided behind the viewing window, with which the operating state or the triggered or triggerable function is indicated to the user of the installation.

SUMMARY OF THE INVENTION

Proceeding from this prior art, the invention is based on the object of specifying an improved apparatus for electrically triggering water discharge, in particular for a flushing installation, which ensures a better function while attaining a high visual standard and making the use simpler and less noticeable for the user.

One problem with the prior art is, amongst others, the immediate visibility of the regions in which the sensors and the associated light sources are arranged. It is furthermore an object of the invention to specify a simplified and at the same time improved detection of the conscious or—if realized—unconscious (owing to the movements of the user) triggering of the water discharge.

According to the proposed solution, the operating plate is divided into regions, which are differently coated on the side that is remote from the user. In the region of the viewing window, in which indication symbols and operation symbols for the user are indicatable, the operating plate is provided with a partially-transmissive coating, with the result that the plate appears non-see-through when the indication symbols and operation symbols do not emit light, whereas when the indication symbols and operation symbols do emit light they are clearly visible to the user.

Window regions in the operating plate, which are adjacent to the viewing window(s), are provided with a coating which is non-transmissive for light that is visible to humans, but is transmissive for infrared wavelengths. The light transmittance for infrared can be selected depending on the IR light source used.

It is also possible for differently coated regions of the operating plate for IR light sources and IR sensors to be provided, with the result that any IR light that is reflected and scattered by a user of the installation is captured and detected by only one of the sensors, and in this manner it is possible to distinguish between proximity detection and operation detection.

By stating that the infrared light from the light source is detectable by the IR sensor when a user is situated within a proximity range in front of the operating plate, this means that a threshold value, which is specified or specifiable/settable by a circuit, is exceeded when a user approaches, with the result that the corresponding response signal from the sensor to the circuit is detected.

Emitted infrared radiation is of course always reflected and back-scattered by the room in which the apparatus is located, regardless of whether this IR light originates from IR light sources of the apparatus or from other light sources. Except this radiation is not "detected", since its measured value, with correct setting, is below the set threshold value.

In one advantageous embodiment, two IR sensors are used, a first sensor for the far-range detection of a user approaching the installation (which, for example, may trigger a forced flush after a certain period of time) and a second sensor (and/or third sensor) for the near-range detection of the user, for example if he would like to select the short flush or a long flush in a toilet system. The corresponding signal values are used by appropriately evaluating the reflected light components.

In order to improve detection, in each case two or more sensors can be used for the far-range detection and/or for the near-range detection so as to adapt the sensitivity of the sensors to the respective situation. A further sensor can be used to detect the position of the user, for example by triangulation. The other way around, it is also possible to use a plurality of IR light sources; for example one behind the indication region for the long flush and one behind the indication region for the short flush, with a single IR sensor in the centre between them; in which case the two IR light sources take turns to emit radiation and thus a signal will be detected intermittently by the single sensor. If, then, a hand of a user is moved in front of one of the indication regions, this signal is absent and the circuit, which is located behind it, recognizes that a triggering operation is intended to be executed.

In one advantageous embodiment, a broadband or combined IR light source is provided, in which case the two different far-range and near-range sensors are sensitive to other IR wavelength ranges. It is also possible for two light sources operating in different IR wavelength ranges to be detected using two sensors, which are either inherently sensitive to these different IR wavelength ranges or are arranged behind appropriately coated regions of the operating plate. Alternatively it is possible to perform temporal discrimination of the emitted and detected signals, so that these can be generated by IR light sources of the same wavelength range without problem.

The operating plate has opaque and partially transmissive (IR or visible light) regions. The user, however, perceives the operating plate to be one homogeneous surface, and only notices a function because of the indication luminous sources.

Further embodiments are stated in the dependent claims.

SUMMARY OF THE DRAWINGS

Preferred embodiments of the invention will be described below with reference to the single drawing which serves merely for explanation purposes and must not be considered to be limiting. The drawing shows: a schematic exploded view from the front of an operating plate with light sources and light sensors, which are arranged behind the operating plate, and an optional fixing frame.

DESCRIPTION OF PREFERRED EMBODIMENTS

FIG. 1 shows a schematic exploded view from the user side of an operating plate 1 according to one exemplary embodiment of the invention of an apparatus for electrically triggering water discharge. Arranged behind the operating plate 1 are various light sources 10, 11, 20 and sensor elements 31, 32 and 33; finally, a schematic depiction of an optional base frame 2 is shown. The illustration of the base frame 2 by itself shows that there are elements which are not shown in the FIGURE, for example those to which the individual light sources 10, 11, 20 and sensor elements 31, 32 and 33 and the operating plate 1 are attached. Such a base frame or fixing frame 2 is typically installed in an opening in a wall which is closed off towards the user side by way of the operating plate 1.

The dimensions of the operating plate 1 can be for example approximately 150 times 250 millimeters. Individually coated regions of the sensor regions 31, 32, 33 and of the opaque regions 9 can have a size of 15 times 30 millimeters, while the indication regions 22 and 23 are for example 60 times 90 millimeters in size.

This operating plate 1 consists of a see-through material, in particular and for example of glass. It may also be Plexiglas, toughened glass or safety glass. The feature see-through means in this case with respect to the material that the plate 1 is transparent for the wavelength ranges of visible light and infrared light. Visible light means in this case light that is visible to a human user, in particular light in the wavelength range between 380 and 780 nanometers, and infrared light is light in the infrared range, which is generally not detectable by a human user, in particular light in the wavelength range between 780 nanometers and 3 micrometers, what is referred to as near infrared, wherein a wavelength range between 780 nanometers and 1 micrometer is particularly useful. The operating plate 1 can also be translucent, with a diffusion of less than 5% being advantageous for a clear indication of the light elements and a targeted transmission of the infrared sensor radiation.

At least two light sources 10 and 20 are provided behind the operating plate 1. The indication luminous source 10 is a light source emitting light that is visible to the human eye, in particular in the wavelength range between 380 and 780 nanometers, mostly in the range between 400 and 700 nanometers. The further sensor luminous source 20 emits near-infrared radiation, in particular at a first infrared wavelength, for example in the range of 880 to 950 nanometers.

Furthermore provided behind the operating plate 1 is an infrared sensor 32. The sensor 32 is spatially arranged such that it picks up light from the sensor luminous source 20 when the hand of an operator is placed in front of a predetermined trigger region 42 of the operating plate 1.

In the see-through operating plate 1, the elements mentioned of the sensor luminous source 20 and of the infrared sensor 30 would now be visible to such a user. The operating plate 1 is therefore provided in a plurality of regions with different coatings applied on the side that is remote from the user. The regions and the coatings are synonymously provided with identical reference signs, specifically 9, 21, 22, 23, 52 and 53. However, in fact these are different coating regions characterized by their coating.

The regions 9 are provided with a coating that is opaque to visible light and non-see-through for infrared light, in particular with a black layer, for example with a black varnish layer. As such, a pigment layer can be used, as is known from JP 2003/086 337.

The region 42 in front of the indication luminous source 10 is provided with a coating 22, which is preferably transmissive or at least partially transmissive only for the wavelength range of the indication luminous source 10. In this case, what is meant by a partially transmissive coating 22, 23 of the indication surface region 42, 43 is that it is partially transmissive for a light wavelength range that is visible to the human eye, while having a transmittance of at least 1% and at most 50%, advantageously between at least 2% and at most 15%.

A user can thus see the light emitted from the indication luminous source 10 behind the operating plate 1, in particular when it changes due to his approaching hand in front of the region 42, in particular switches on, increases in terms of intensity or varies. Preferably in this case the coated region 22 is spatially larger than the region 42 that is characterized as the trigger region, so that the light from the indication light source 10 can also be seen from various angles by the user as it passes through the operating plate 1. In particular, the coating of the regions 22 and 23 can also be partially reflective. If the indication surface region 22 and 23 is dimensioned appropriately larger with respect to the trigger region 42 and 43, the light from the indication light sources 10 and 11 passing through the operating plate 1 can be perceived from an angle of up to 45 degrees relative to the perpendicular of the operating plate 1 in the centre of the operating plate 1. However, the sensors and light sources are advantageously arranged close behind the operating plate 1, with the result that the reading angles do not play any significant role due to the small distances behind the operating plate 1; in particular, sensors and operating plate 1 are advantageously separably connected.

The region 21 in front of the sensor light source 20 is covered with a coating which transmits light at wavelengths from the range of the infrared sensor light source 20, preferably only a narrow wavelength range comprising only a range around the wavelength of this infrared light from the light source 20. It is possible for non-see-through coating regions 9 and regions 22 and 23, which are transmissive only for visible light, to be arranged around the region 21, because the sensor light source 20 needs to emit light only through the region 21 in an angle cone that permits a user or a user's hand, located at a specific distance from and range in front of the operating plate 1, to generate a reflected and/or diffusely scattered signal which falls back in the direction of the operating plate 1, through the window 52, and strikes the sensor 32.

The region 52 of the operating plate in front of the infrared sensor 32 is covered on its rear side with a coating which is transmissive to light from the infrared sensor light source 20, preferably a narrow wavelength range around only this infrared light wavelength. The material used in this case may be the material S306 from Optical Filters, which has a high transmittance between 800 and 1400 nanometers, but nearly completely blocks light of less than 700 nanometers.

In a flushing panel, two trigger regions 42 and 43 are provided, for example, one for a long flush and one for a short flush. In this case, the abovementioned first indication light source 10 and for example a second indication light source 11 are located on either side of the sensor light source 20. For this second indication light source 11, analogously, a viewing region 23 is provided, which has a second trigger region 43 in front of the second light source 11. The coating of the region 23 corresponds to the coating 22 in respect of the transmitted wavelength.

In this case, a second infrared sensor 33 is preferably provided, which is arranged behind a transmissive region 53. The transmissive region 53 has a coating with the same properties as the coating 52 in respect of the transmitted (infrared) wavelength.

Thus, with the exception of the regions in front of the light sources 10, 11, 20, all other surface regions 9 of the operating plate 1 are coated and non-see-through when viewed from in front of the operating plate 1, that is to say the sensor transmission field 21 and the indication regions 22 and 23 and also the sensor regions 51, 52 and 53. The coatings may overlap slightly. It is likewise possible for the sensor regions 51, 52 and 53 and also 21 to be separated from the indication regions 22 and 23 by way of coating regions 9 which are in each case opaque to both sight and IR light, which is not the case in the exemplary embodiment illustrated in the drawing.

In another embodiment, which is integrated in the FIGURE, a third central infrared sensor 31 is provided behind a further coating region 51, with which sensor light can be picked up when a user of the flushing apparatus approaches. The sensor can pick up the light from said sensor light source 20 or a second proximity light source. This sensor 31 triggers when a user is located in a proximity region in front of the operating plate 1.

It is advantageous here, that the regions and light sources are arranged such that crosstalk of the signals is unlikely because the optical paths of the sensors are designed differently. For example, the sensor 32 detects the scattered light from a hand of the user in front of the region 42, which passes through the region 52 and strikes the sensor 32, that is to say left of the centre of the operating plate 1. The sensor 33 detects the scattered light from a hand of the user in front of the region 43, which passes through the region 53 and strikes the sensor 33, that is to say right of the centre of the operating plate 1. Contrary to this, the sensor 31 detects the scattered light from the far-away user in front of the plate itself, which in the process passes through the region 51 and strikes the sensor 31, that is to say at the bottom in the centre of the operating plate 1.

According to another exemplary embodiment, the sensors 31, 32 and 33 are sensitive to respectively different wavelength ranges, for example the central proximity sensor 31 to 880 nanometers and the trigger sensor 32 and, if there are two, the trigger sensor 33 to 950 nanometers. Here the coating of the regions 52 and 53 and also of the region 51 can be matched only to these respective wavelength ranges. The region 21 in front of the or a combined sensor light source 20, on the other hand, is transmissive to both wavelength ranges. Further spaced-apart wavelength ranges can also be used in this case, such as 1300 nanometers and 900 nanometers.

In a more complex exemplary embodiment, rather than one sensor light source 20, separate sensor light sources (not shown in the drawing) are provided, which are arranged for example to the left and to the right above the indication regions 22 and 23, such that the optical paths to the triggering hand and the paths of the scattered light back are completely separate, because the IR light sources above the indication regions 22 and 23 are directed downwards to the front and thus crosstalk can be avoided owing to the lateral distance.

A dark background closing off the space behind the operating plate 1 can prevent a user from seeing through to the region of the system behind the fixing frame 2.

In order to control the light sources 10, 11 and 20 and the sensors 31, 32 and 33, an electric control circuit (not illustrated in the drawing) is provided, in which preferably settable trigger threshold values for the proximity sensor 31 and the water-discharge sensors 32 and 33 are stored; in which the orientation of the light sources 10, 11 and 20 are taken into account and, if appropriate, the latter are adapted.

LIST OF REFERENCE SIGNS

1 operating plate
2 fixing frame
9 region blocking visible and IR light
10 indication luminous source long flush
11 indication luminous source short flush
20 sensor luminous source
21 emission transmissive region
22 indication region long flush
23 indication region short flush
31 infrared sensor
32 infrared sensor
33 infrared sensor
42 trigger region long flush
43 trigger region short flush
51 proximity transmissive region
52 receiving transmissive region long flush
53 receiving transmissive region short flush

The invention claimed is:

1. An apparatus for electrically triggering water discharge, comprising:

an operating plate, at least one sensor, at least a first coating, a second coating and a third coating, and at least one light source, wherein said at least one sensor is arranged in a rearwards region, when viewed by a user triggering the water discharge, behind the operating plate, wherein said operating plate is a plate which is transmissive for light that is visible to the human eye and for near-infrared light, wherein said operating plate has at least one indication surface region on a side that is remote from the user, wherein said at least one indication surface region is provided with the first coating, said first coating being a partially transmissive coating behind which at least one light source is arranged which emits light that is visible to the human eye, wherein said operating plate has at least one signal-transmitter surface region on the side that is remote from the user, wherein said at least one signal-transmitter surface region is provided with the second coating being a coating that is partially transmissive for infrared light, behind which at least one light source, which emits light of at least one infrared wavelength, is arranged, wherein said operating plate has at least one sensor surface region on the side that is remote from the user, and wherein said at least one sensor surface region is provided with the third coating, said third coating being a coating that is partially transmissive for infrared light, behind which at least one sensor that is sensitive to infrared light is arranged.

2. The apparatus according to claim 1, wherein the second coating provided at said at least one signal-transmitter surface region is a coating that is non-transmissive for light that is visible to the human eye and is partially transmissive for infrared light, and wherein the third coating provided at said at least one sensor surface region is with a coating that is non-transmissive for light that is visible to the human eye and is partially transmissive for infrared light.

3. The apparatus according to claim 1, wherein said operating plate has at least one proximity-sensor surface region on the side that is remote from the user, and wherein the third coating provided at said at least one proximity-sensor surface region is a coating that is non-transmissive for light that is visible to the human eye and is partially transmissive for infrared light, behind which at least one proximity sensor which is sensitive to infrared light is arranged, with which the infrared light from the light source is detectable when a user is located in a proximity region in front of the operating plate.

4. The apparatus according to claim 3, wherein said at least one proximity sensor which is sensitive to infrared light is arranged spatially between the trigger sensors for controlling water discharge.

5. The apparatus according to claim 4, wherein said infrared light in at least two different wavelength ranges is generated by the at least one sensor light source and wherein said at least one proximity sensor and said at least one trigger sensor for controlling the water discharge are sensitive to different wavelength ranges.

6. The apparatus according to claim 4, wherein said infrared light in at least two different wavelength ranges is generatable by the at least one sensor light source, and wherein said at least one proximity-sensor surface region and said at least one trigger-sensor surface region for controlling the water discharge are partially transmissive for different wavelength ranges.

7. The apparatus according to claim 1, wherein said sensors which are sensitive to infrared light are arranged directly behind the sensor surface regions.

8. The apparatus according to claim 1, wherein said indication light sources are arranged directly behind the indication surface regions, and wherein said indication surface regions are larger than the surface regions taken up by the indication light sources, such as the light from the indication light sources, which passes through the operating plate, is perceivable from an angle of up to 45 degrees relative to the perpendicular of the operating plate in the centre of the operating plate.

9. The apparatus according to claim 1, wherein said individual indication regions and sensor regions as well as the IR-light-source-transmissive regions are separated from one another by regions which are opaque to both sight and IR light.

10. The apparatus according to claim 1, wherein said individual indication regions and sensor regions are perceived by a user as one homogeneous surface of the operating plate.

11. The apparatus according to claim 1, wherein said individual indication regions and sensor regions and the regions which are opaque to both sight and IR light are perceived by a user as one homogeneous surface of the operating plate.

12. The apparatus according to claim 1, wherein said operating plate is attached to a base frame.

13. The apparatus according to claim 1, wherein said operating plate is attached to a base frame, whereas the sensors are also attached to said base frame.

14. The apparatus according to claim 1, wherein said operating plate is attached to a base frame, and wherein the sensors and the indication light sources are also attached to said base frame.

15. The apparatus according to claim 1, wherein said partially-transmissive first coating of the indication surface regions is partially transmissive at least for a light wavelength range that is visible to the human eye.

16. The apparatus according to claim 15, wherein said partially-transmissive first coating of the indication surface regions has a transmittance of at least about 1% and at most about 50% for said light wavelength range.

17. The apparatus according to claim 16, wherein said partially-transmissive first coating of the indication surface regions has a transmittance of at least about 2% and at most about 15% for said light wavelength range.

* * * * *